US006332337B1

(12) United States Patent
Rohde

(10) Patent No.: US 6,332,337 B1
(45) Date of Patent: Dec. 25, 2001

(54) METHOD AND APPARATUS FOR RECOVERING OXYGEN AT HYPERBARIC PRESSURE

(75) Inventor: Wilhelm Rohde, München (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/634,006

(22) Filed: Aug. 7, 2000

(30) Foreign Application Priority Data

Aug. 5, 1999 (DE) ..... 199 36 816

(51) Int. Cl.[7] ..... F25J 1/00
(52) U.S. Cl. ..... 62/646; 62/654
(58) Field of Search ..... 62/646, 654

(56) References Cited

U.S. PATENT DOCUMENTS 5,379,598 * 1/1995 Mostello ..... 62/654
5,396,773 * 3/1995 Ha et al. ..... 62/654
5,515,687 * 5/1996 Arriulou ..... 62/654
5,533,339 * 7/1996 Clare et al. ..... 62/654

FOREIGN PATENT DOCUMENTS 25 44 340 4/1977 (DE) .

* cited by examiner

*Primary Examiner*—Ronald Capossela
(74) *Attorney, Agent, or Firm*—Crowell & Moring LLP

(57) ABSTRACT

An method for the recovery of oxygen at hyperbaric pressure by low-temperature air fractionation includes compressing feed air to a first pressure, which is about the same as the operating pressure of the pressure column. At least a first partial flow of the feed air is cooled in a main heat exchanger and passed into the pressure column. An oxygen flow is tapped from the low-pressure column; brought to a delivery pressure that is higher than the operating pressure of the low-pressure column; heated in the main heat exchanger; and discharged as product. The pressure of a process stream from the main heat exchanger is relieved in a work-expanding manner, and the process stream is supplied to the low-pressure column. At least a portion of the mechanical energy generated by the work-expanding is used to drive a cold compressor. The flow of liquid oxygen from the low-pressure column is brought to the delivery pressure, and the oxygen is then evaporated by indirect heat exchange with a second partial flow of feed air, which has been compressed to the first pressure. The second partial flow is brought to a second pressure by the cold compressor upstream of the indirect heat exchange.

5 Claims, 1 Drawing Sheet

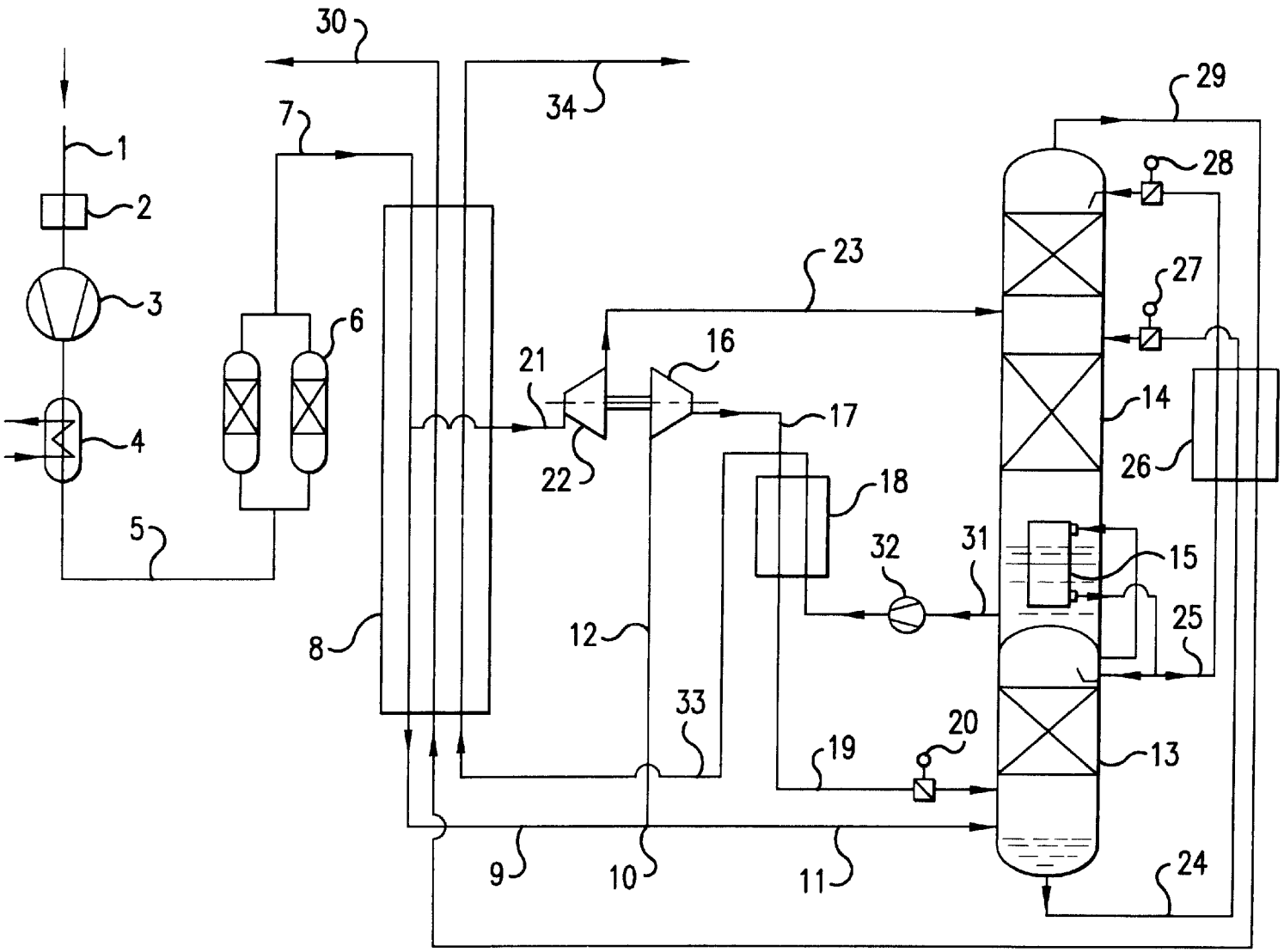
1
2
3
4
5
6
7
8
9
10
11
12
13
14
15
16
17
18
19
20
21
22
23
24
25
26
27
28
29
30
31
32
33
34

METHOD AND APPARATUS FOR RECOVERING OXYGEN AT HYPERBARIC PRESSURE

BACKGROUND AND SUMMARY OF THE INVENTION

This application claims the priority of German application No. 199 36 816.3, filed Aug. 5, 1999, the disclosure of which is expressly incorporated by reference herein.

The present invention relates to a method for recovering oxygen at hyperbaric pressure by low-temperature air fractionation in a rectifying system which comprises at least one pressure column and one low-pressure column. Feed air is compressed to a first pressure which is about the same as the operating pressure of the pressure column. At least a first partial flow of the feed air is cooled at the first pressure in a main heat exchanger and passed into the pressure column. An oxygen flow is tapped from the low-pressure column; brought to a delivery pressure that is higher than the operating pressure of the low-pressure column; heated in the main heat exchanger; and discharged as product. The pressure of a process stream is work-expanded and the process stream is supplied to the low-pressure column. At least a portion of the mechanical energy, generated by the work-expansion of pressure, is used to drive a cold compressor.

A method and a corresponding apparatus are known from DE 2544340 A. The refrigeration performance of a pressure-expanding turbine in many cases is greater than the amount of refrigeration required by the plant. The excess energy is used to drive a cold compressor, which compresses an oxygen product from the low-pressure column in the gaseous state, before it is heated in the main heat exchanger.

It is an object of the present invention to make such a method energetically more advantageous.

This objective is accomplished due to the fact that the flow of oxygen from the low-pressure column in the liquid state is brought to the delivery pressure. The oxygen is evaporated by indirect heat exchange with a second partial flow of the feed air, which has been compressed to the first pressure. The second partial flow is brought upstream of the indirect heat exchange to a second pressure by the cold compressor.

Thus, according to the present invention, instead of the oxygen product flow itself, a partial air flow, which is used for the evaporation of the oxygen flow and is drawn off as a liquid under an elevated pressure, is brought to a higher pressure by the cold compressor driven by the expansion machine. In spite of this indirect transfer of the energy to the oxygen product flow, a larger effect can be achieved in this way. For the same loss of refrigeration, the pressure at which the oxygen is delivered is higher at the cold compressor than in the case of the previously known method.

The first pressure, to which the first and second partial flows of air are compressed jointly, is slightly above the operating pressure of the pressure column. The pressure difference preferably is such that the first partial flow of the air can overcome the flow resistance between the air compressor and the pressure column without pressure-changing measures and amounts, for example, to 0.1 to 0.5 bar.

The operating pressures at the head of the rectifying columns are, for example, (1) 2.5 to 10 bar, and preferably 4 to 7 bar in the pressure column, and (2) 1.05 to 4 bar, and preferably 1.1 to 1.5 bar in the low pressure column.

Preferably, an air compressor is used as the only externally driven machine for the method. This brings the total air to the first pressure, which at the same time represents the feed pressure of the expansion machine and the cold compressor. In this way, the oxygen product can be obtained at a delivery pressure, which is, for example, 0.5 to 4 bar, and preferably 1 to 3 bar, above the operating pressure of the low-pressure column. However, this is not associated with an energy consumption higher than that required for recovering the oxygen product at the pressure of the low-pressure column.

During the indirect heat exchange with the evaporating oxygen, the cold-compressed partial flow of air is condensed at least partially and preferably completely or essentially completely. The pressure on the condensate is subsequently relieved and the condensate is passed on to the pressure column and/or the low-pressure column.

The inventive method is particularly suitable for recovering impure oxygen with a purity of 80 to 99.5 mole % and preferably of 90 to 95 mole % at hyperbaric pressure.

For the method, nitrogen from the head of the pressure column, for example, or any other fraction from the pressure column can be supplied to the work-expansion. Preferably however, the process stream, which is subjected to the work-expansion, expansion, is formed by a third partial stream of the feed air, which is compressed to the first pressure.

Basically, it is possible to carry out the indirect heat exchange, through which the product oxygen is evaporated against the second partial stream of air that is condensing, in the main heat exchanger. Preferably however, a side condenser, separate from the main heat exchanger, is provided and is constructed as a cycling evaporator. Alternatively, it is also possible to use a counter-current heat exchanger or a falling film evaporator as a side condenser.

It is furthermore advantageous if a portion of the mechanical energy produced by the work-expansion is passed on to a braking device. The braking device may be formed, for example, by a braking fan and/or a braking generator and is outside of the cold box, which insulates the cold parts of the apparatus. By these means, energy can be emitted to the environment and the refrigeration, necessary for the method can be obtained without using a further expansion machine. Preferably, the expansion machine, the cold compressor, and the braking device are directly coupled mechanically, for example, over a common shaft.

Other objects, advantages and novel features of the present invention will become apparent from the following detailed description of the invention when considered in conjunction with the accompanying drawings.

BRIEF DESCRIPTION OF THE DRAWING

The sole FIGURE is a diagram of an apparatus for recovering oxygen by low-temperature air fractionation according to the present invention.

DETAILED DESCRIPTION OF THE DRAWING

Atmospheric air 1, after flowing through a filter 2, is compressed in an air compressor 3 to a first pressure, which is approximately equal to the operating pressure of the pressure column 13. To overcome line losses, the first pressure must be slightly higher than the pressure column pressure, for example, by less than 1 bar and preferably by 0.5 bar or less.

After removal of the heat of compression in aftercooler 4, the air 5, compressed to the first pressure, flows to purification equipment 6, which is formed by a pair of reversible molecular sieve adsorbers. After purification 6, the air which is compressed to the first pressure flows through conduit 7 to the first heat exchanger 8 and is partly cooled there approximately to the dew point. At 10, cold air 9 is divided into (1) a first partial flow 11, and (2) a second partial flow 12. The first partial flow 11 is supplied directly to the pressure column 13 of the rectifying system and, moreover, directly above the sump. In addition, the rectifying system has a low-pressure column 14 which, over a common condenser-evaporator (the main condenser 15), is in a heat-exchanger relationship with the pressure column 13.

In a cold compressor 16, the second partial flow 12 is brought to a second, higher pressure, passed through conduit 17 to a side condenser 18, which is constructed as a cycling evaporator (not shown) and liquefied there essentially completely. The liquefied air 19 is throttled through a valve 20 into pressure column 13, either at the sump or at an intermediate position, which is a few theoretical or practical. plates above the feed for the first partial flow 11.

A further portion of the air 7, which has been compressed to the first pressure and subsequently purified, is taken out of the main heat exchanger 8 at an intermediate temperature and forms a third partial stream 21. In an expansion turbine 22, the pressure of this third partial stream 21 is expanded in a work-generating manner to about the pressure of the low-pressure column. The third partial flow 21 is passed through conduit 23 directly to the low-pressure column 14. The expansion turbine 22 is coupled over a common shaft with the cold compressor 16 and with a brake generator, which is not shown.

Crude liquid oxygen 24 from the sump of the pressure column 13 and liquid nitrogen 25 from the main condenser 15 are cooled in counter-current undercooling equipment 26 and, through valves 27 or 28 are transferred to the low-pressure column 14.

At the head of the low-pressure column 14, nitrogen-rich residual gas 29 is drawn off and, after being heated in the counter-current undercooling equipment 26 and, in the main heat exchanger 8, discharged through conduit 30. It can also be used as recovered gas in the purification gas equipment 6 (not shown).

As sump product of the low-pressure column 14, liquid oxygen of the required purity is obtained. A portion is drawn off in liquid form through conduit 31; brought to the required delivery pressure by a pump 32; and evaporated at this pressure in the side condenser 18. The gaseous oxygen product under pressure flows through conduit 33 to the main heat exchanger and is discharged through conduit 34 at about ambient temperature.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for recovering oxygen at hyperbaric pressure by low-temperature air fractionation in a rectifying system that comprises a pressure column and a low-pressure column, said method comprising:

compressing feed air to a first pressure that is approximately equal to an operating pressure of the pressure column;

cooling at least a first partial flow of the feed air compressed to the first pressure in a main heat exchanger;

passing the cooled first partial flow into the pressure column;

work-expanding the pressure of a process stream from the main heat exchanger and supplying the process stream to the low-pressure column, wherein at least a portion of the mechanical energy generated by the work-expanding of the process stream drives a cold compressor;

tapping a liquid oxygen flow from the low-pressure column;

bringing the liquid oxygen flow to a delivery pressure that is higher than the operating pressure of the low-pressure column;

evaporating the liquid oxygen flow by indirect heat exchange with a second partial flow of the feed air compressed to the first pressure which is brought to a second pressure by the cold compressor;

heating the evaporated oxygen flow in the main heat exchanger; and discharging the heated oxygen flow.

2. A method according to claim 1, wherein the process stream is a third partial flow of the feed air compressed to the first pressure.

3. A method according to claim 1, wherein the indirect heat exchange is carried out in a side condenser that is separate from the main heat exchanger.

4. A method according to claim 1, further comprising transferring a portion of the mechanical energy generated by the work-expansion to a braking device.

5. An apparatus for the recovery of oxygen at hyperbaric pressure by the low-temperature fractionation of air with a rectifying system that comprises a pressure column and a low-pressure column, comprising:

a pressure column;

a low-pressure column;

an air compressor for compressing feed air to a first pressure that is approximately equal to an operating pressure of the pressure column;

a first partial air conduit that is connected with the air compressor and with the pressure column and that passes through a main heat exchanger;

an oxygen product conduit having means for increasing pressure of a liquid oxygen flow from the low-pressure column and connecting the low-pressure column and an evaporation space of a condenser-evaporator;

an expansion machine coupled with a cold compressor; and a second partial air conduit leading from the air compressor to the cold compressor and from the cold compressor into a liquefying space of the condenser-evaporator.

* * * * *